US008735749B2

(12) United States Patent
Yang

(10) Patent No.: US 8,735,749 B2
(45) Date of Patent: May 27, 2014

(54) PUSH HANDLE SWITCH LAMPHOLDER

(71) Applicant: Rich Brand Industries Limited, Dongguan (CN)

(72) Inventor: Wen Ho Yang, Tainan (TW)

(73) Assignee: Rich Brand Industries Limited, Dongguan, Guangdong Province (CN)

( * ) Notice: Subject to any disclaimer, the term of this patent is extended or adjusted under 35 U.S.C. 154(b) by 67 days.

(21) Appl. No.: 13/685,780

(22) Filed: Nov. 27, 2012

(65) Prior Publication Data

US 2013/0084749 A1 Apr. 4, 2013

Related U.S. Application Data

(63) Continuation-in-part of application No. 13/215,422, filed on Aug. 23, 2011, now Pat. No. 8,357,863.

(51) Int. Cl.
*H01R 33/22* (2006.01)

(52) U.S. Cl.
USPC ..... 200/51.09; 362/441

(58) Field of Classification Search
USPC ..... 200/51.09, 51.14, 51.16; 362/441, 435
See application file for complete search history.

(56) References Cited

U.S. PATENT DOCUMENTS

| | | | | |
|---|---|---|---|---|
| 3,798,440 | A * | 3/1974 | Brindley | 362/205 |
| 4,504,713 | A * | 3/1985 | Hennessey | 200/241 |
| 5,260,858 | A * | 11/1993 | Maglica | 362/205 |
| 8,142,058 | B2 * | 3/2012 | Yang | 362/441 |

* cited by examiner

*Primary Examiner* — Gary F. Paumen
(74) *Attorney, Agent, or Firm* — Bacon & Thomas, PLLC

(57) ABSTRACT

A push handle switch lampholder pushes a lower conductive plate to move like a see-saw by pushing a push handle to move back and forth and determines whether or not to pass a current to an upper conductive plate, so as to control the ON or Off of a light emitting element. In addition, a set of hooks is provided for connecting a power cable for an electric connection without the need of tying an UL knot to expedite the wire connection conveniently and securely. The invention can reduce the number of components and the volume while achieving the effects of lowering the manufacturing, storage and transportation costs, and improving the overall service life of the lampholder.

5 Claims, 5 Drawing Sheets

PUSH HANDLE SWITCH LAMPHOLDER

CROSS REFERENCE TO RELATED APPLICATIONS

This application is a continuation-in-part of U.S. patent application Ser. No. 13/215,422, entitled "PUSH HANDLE SWITCH LAMPHOLDER" and filed on Aug. 23, 2011.

BACKGROUND OF THE INVENTION

1. Field of the Invention

The present invention relates to a push handle switch lampholder, and more particularly to the push handle switch lampholder that pushes a lower conductive plate to move like a see-saw by pushing a push handle to move back and forth and determines whether or not to pass a current to an upper conductive plate, so as to control the ON or Off of a light emitting element. In the meantime, a set of hooks is provided for connecting a power cable for an electric connection without the need of tying an UL knot.

2. Description of the Related Art

With reference to FIG. 1 for a conventional push handle switch lampholder 1, the push handle switch lampholder 1 comprises a cylindrical shell 11, an insulating plate 12, an insulating base 13 and a push handle switch 14, wherein the cylindrical shell 11 is electrically conductive and provided for screwing and connecting a light emitting element such as a light bulb (not shown in the figure), and a first electrode of the light emitting element is contacted with cylindrical shell 11 to electrically couple to a negative electrode of the power supply such as a utility power supply (not shown in the figure). The insulating plate 12 is installed at the bottom of the cylindrical shell 11, and a connecting groove 120 is formed thereon. The insulating base 13 is installed under the insulating plate 12 and includes a containing groove 130 concavely formed on the insulating base 13 for embedding a negative electrode plate 131 and a positive electrode plate 132, and an end of the negative electrode plate 131 is extended to the top of the insulating base 13 and abutted against the bottom of the insulating plate 12, and ends of the cylindrical shell 11, the insulating plate 12, the negative electrode plate 131 and the insulating base 13 are pivotally coupled, so that the negative electrode plate 131 and the cylindrical shell 11 are electrically connected. The positive electrode plate 132 includes a lower conductive plate 132*a*, at least two conductive plates 132*b* and an upper conductive plate 132*c*, and the lower conductive plate 132*a* is embedded into the insulating base 131. The conductive plates 132*b* are contained in both sides of the containing groove 130 respectively, and one of the conductive plates 132*b* proximate to the lower conductive plate 132*a* is electrically coupled to the lower conductive plate 132*a*, and the other of the conductive plates 132*b* is electrically coupled to the upper conductive plate 132*c*, and the upper conductive plate 132*c* is passed out of the connecting groove 120 and contacted with the second electrode of the light emitting element. A set of plug slots 133 is formed on an external surface of the insulating base 13 and their interior is corresponding to the negative electrode plate 131 and lower conductive plate 132*a* separately.

The switch 14 includes a push handle 141, a spring 142 and a metal plate 143, and the push handle 141 is contained in containing groove 130 for performing a pushing action reciprocally in the containing groove 130, and a middle section of the push handle 141 is hooked to an end of the spring 142. The metal plate 143 is substantially C-shaped, and an internal edge of the lower section is latched to the middle section of the push handle 141, and an internal edge of the upper section is hooked to the other end of the spring 142, so that when the push handle is pushed, the push handle is driven by an elastic force of the spring 142 to tilt towards one of the ends of the push handle 141, and the metal plate 143 is contacted with the conductive plates 132*b* on both sides respectively (as shown in FIG. 2). When the push handle 141 drives the spring 142 to link and move the metal plate 143 to tilt towards another end of the push handle 141, the metal plate 143 is released from the contact of the conductive plates on both sides.

In FIG. 3, both bare ends of the power cable 15 are plugged into two plug slots 133 respectively, so that the two bare ends of the power cable 15 push the negative electrode plate 131 and the lower conductive plate 132*a* to connect with each other for an electric connection. Therefore, the push handle 141 can push the metal plate 143 to contact the conductive plate 132*b* on both sides the same time to achieve an ON state, so as to electrically conduct the positive terminal of the power source to light up the light emitting element. On the other hand, the push handle 141 can push the metal plate 143 to disconnect the conductive plate 132*b* on both sides to achieve an OFF state, so as to turn off the light emitting element.

The connection between the push handle switch lampholder 1 and the power cable 15 relies on the negative electrode plate 131 and the lower conductive plate 132*a* to connect both bare ends of the power cable 15 only, so that when the power cable 15 is pulled accidentally or intentionally, the bare ends of the power cable 15 may be separated from the negative electrode plate 131 and/or the lower conductive plate 132*a* to result in a circuit disconnection. In the use of the conventional push handle switch lampholder 1, an UL knot 151 is tied at a position near the bare end of the power cable 15, and then both bare ends are plugged into two plug slots 133 respectively to achieve the effect of connecting the negative electrode plate 131 and the lower conductive plate 132*a* for an electric connection, and the UL knot 151 is intended for increasing the tensile resistance between the switch lampholder 1 and the power cable 15.

The conventional push handle switch lampholder 1 has the following drawbacks:

(1) Difficult Assembly: Since the lampholder 1 uses a number of conductive plates for conducting current to the light emitting element, therefore the overall assembling operation is complicated and tedious, and the position may be shift easily by an external force to affect the effect of the lampholder 1, so that the conventional lampholder 1 incurs a complicated assembling operation and the assembly may be loosened easily by external pushing or squeezing forces to affect the effect of use.

(2) Large Volume: Since the whole switch 14 must be accommodated into the containing groove 130, therefore the insulating base 13 is limited and its volume cannot be reduced effectively. As a result, the cost for the molding process of the insulating base 13 is high, and the large volume will also affect the storage and transportation costs.

(3) Unsmooth Pushing Operation: When a user pushes the push handle 141, a force greater than the elastic force of the spring must be applied to the push handle 141 before the metal plate 143 can be driven to contact with or separate from the positive electrode plates 132 on both sides. If the elastic force of the spring 142 is too large, then the user has to push the push handle 141 inconveniently. If the elastic force of the spring 142 is too small, then the push handle 141 will be too loose to cause a wrong movement. In addition, the spring 142 may become elastically fatigue after a long time of use, so as to affect the operation and effect of the lampholder 1.

(4) Short Service Life: Since the metal plate 143 and the conductive plates 132*b* on both sides are contacted to allow a current flow, and the contact position is a point or a line, the metal plate 143 produces a high temperature and becomes deteriorated or broken after a long time of use, so as to shorten the service life of the lampholder 1.

(5) Complicated Tie of UL Knot: The process of tying an UL knot 151 at a position proximate to a bare end of the power cable 15 is troublesome, not only increasing the manufacturing time and cost, but also increasing the storage and transportation costs since the UL knot 151 has a relatively large volume and it is difficult to reduce the total volume of the switch lampholder 1. Particularly, the UL knot increases the tensile resistance between the switch lampholder 1 and the power cable 15, but fails to assure a secured connection between the switch lampholder 1 and the power cable 15 when a strong force is applied.

SUMMARY OF THE INVENTION

In view of the aforementioned drawbacks of the conventional push handle switch lampholder, the inventor of the present invention based on years of experience in the related industry to conduct extensive researches and experiments, and finally invented the present invention to overcome the drawbacks of the prior art.

Therefore, it is a primary objective of the present invention to provide a push handle switch lampholder capable of simplifying components, reducing volume, controlling the ON and OFF of a light emitting element easily, facilitating the fixation of the power cable for an electric connection, lowering the manufacturing, storage and transportation costs, and improving the service life.

To achieve the aforementioned objective, the present invention provides a push handle switch lampholder comprising: a cylindrical shell, formed by a conductive plate into a substantially cylindrical shape, and having a threaded mouth, and a containing space separately formed at the top and the bottom of the interior of the cylindrical shell, for screwing and connecting a light emitting element, such that a first electrode of the light emitting element is attached to the cylindrical shell for an electric conduction; an insulating plate, installed at the bottom of the cylindrical shell, and having a connecting groove for passing and embedding an upper conductive plate, and the top of the insulating plate being exposed from the top end of the upper conductive plate and extended into the containing space of the cylindrical shell, and contacted with a second electrode of the light emitting element for an electric conduction, and the other end of the upper conductive plate being extended to the bottom of the insulating plate; an insulating base, installed at the bottom of the insulating plate, and having a containing grove concavely formed at the top of the insulating plate and transversally penetrating through the top of the insulating plate, a set of plug slots formed on an external surface opposite to the containing groove for plugging and connecting a power cable; and a set of hooks disposed proximate to the corresponding plug slots respectively for connecting the power cable; a push handle, installed in the containing groove, and capable of performing a reciprocating push movement along the containing groove, and having a protruding portion protruded from the push handle; and a lower conductive plate, being substantially in a curved shape matched with the top edge of the containing groove, for being movably fixed at a position of the containing groove corresponding to the protruding portion; thereby, in the process of performing the reciprocating push movement by the push handle, the protruding portion of the push handle abuts a position proximate to an end of the lower conductive plate, such that an end of the upper conductive plate is moved in a direction towards the upper conductive plate and contacted with the upper conductive plate to electrically connect and light up the light emitting element, and when the protruding portion abuts a position proximate to the other end of the lower conductive plate, an end of the lower conductive plate is moved in a direction away from the upper conductive plate and separated from the upper conductive plate to electrically disconnect and turns off the light emitting element.

In the push handle switch lampholder, the insulating base includes a positive electrode plate and a negative electrode plate embedded into both sides of the containing groove respectively, and an end of the positive electrode plate is exposed from the top of the insulating base and extended to a position of the top of the containing groove proximate to the lower conductive plate, and the other end of the positive electrode plate is extended downwardly inside the insulating base 33 and corresponding to one of the plug slots, and an end of the negative electrode plate is extended out from the top of the insulating base, and the other end of the negative electrode plate is extended downwardly inside the insulating base and corresponding to another plug slot, so that when the power cable is plugged into the corresponding plug slots, the power cable is connected with terminals of the positive electrode plate and the negative electrode plate for an electric connection.

The push handle switch lampholder further comprises a connecting element, and at least one hole formed at corresponding position of the cylindrical shell, the insulating plate and the insulating base for passing the connecting element to secure the cylindrical shell, the insulating plate and the insulating base.

In the push handle switch lampholder, the negative electrode plate is extended from a terminal at the top of the insulating base to a hole formed on the insulating base and proximate to the negative electrode plate, such that after the connecting element is passed through the hole, a terminal of the negative electrode plate is electrically coupled to the connecting element.

In the push handle switch lampholder, each hook includes a vertical column integrally formed with the insulating base, and the top edge of the vertical column is extended outwardly to form a hook portion, and the rear end is protruded downwardly to form an assisting hook end; and when the power cable is pushed across the assisting hook end to enter into the hook portion, the power cable and the hook portion are connected securely with each other.

DETAILED DESCRIPTION OF THE PREFERRED EMBODIMENTS

The objectives, technical characteristics, measures, effects and advantages of the present invention will become apparent with the detailed description of preferred embodiment accompanied with the illustration of related drawings as follows.

Figure 1:
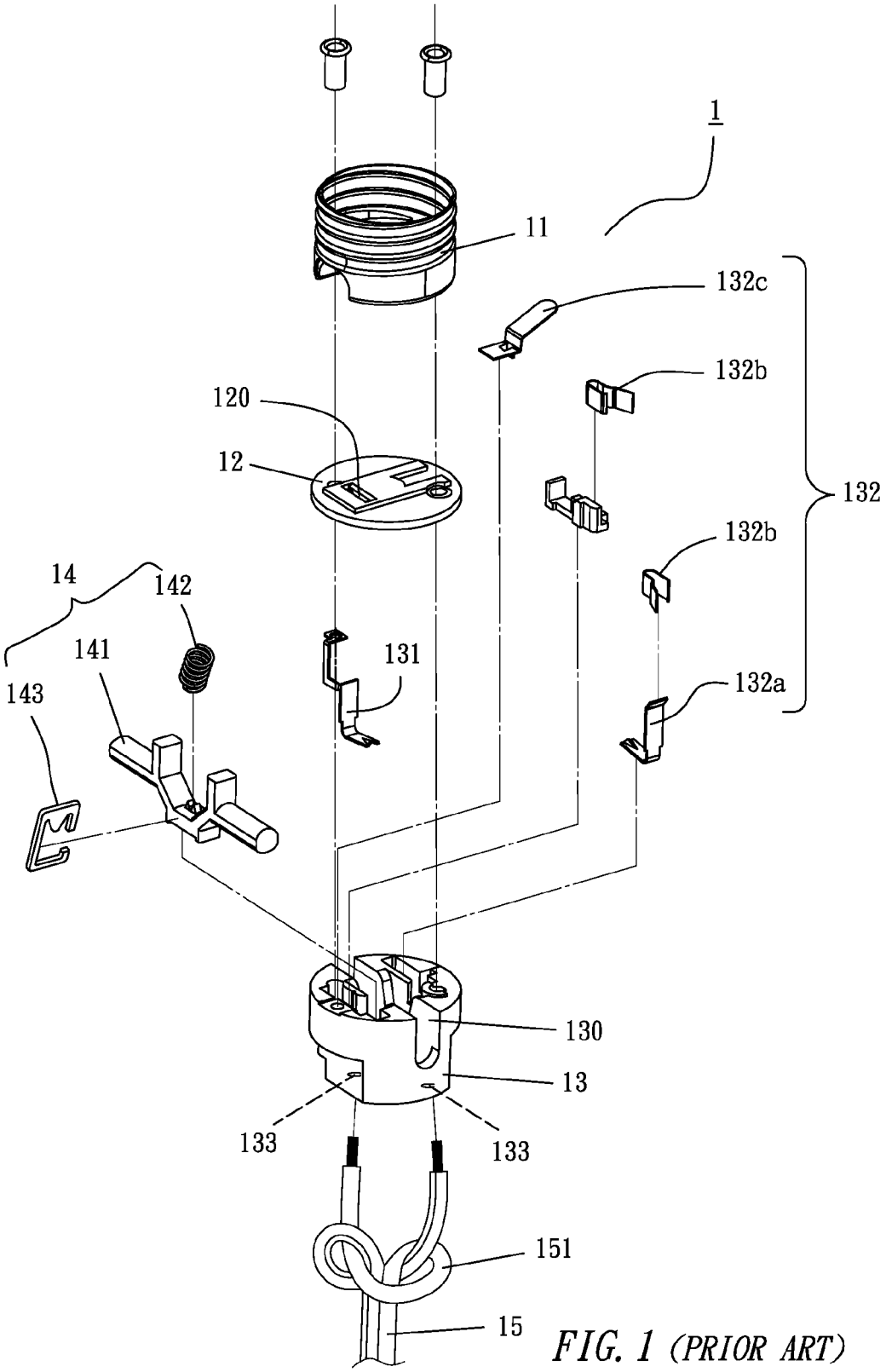
FIG. 1 (PRIOR ART)
FIG. 1 is an exploded view of a conventional lampholder.
Figure 2:
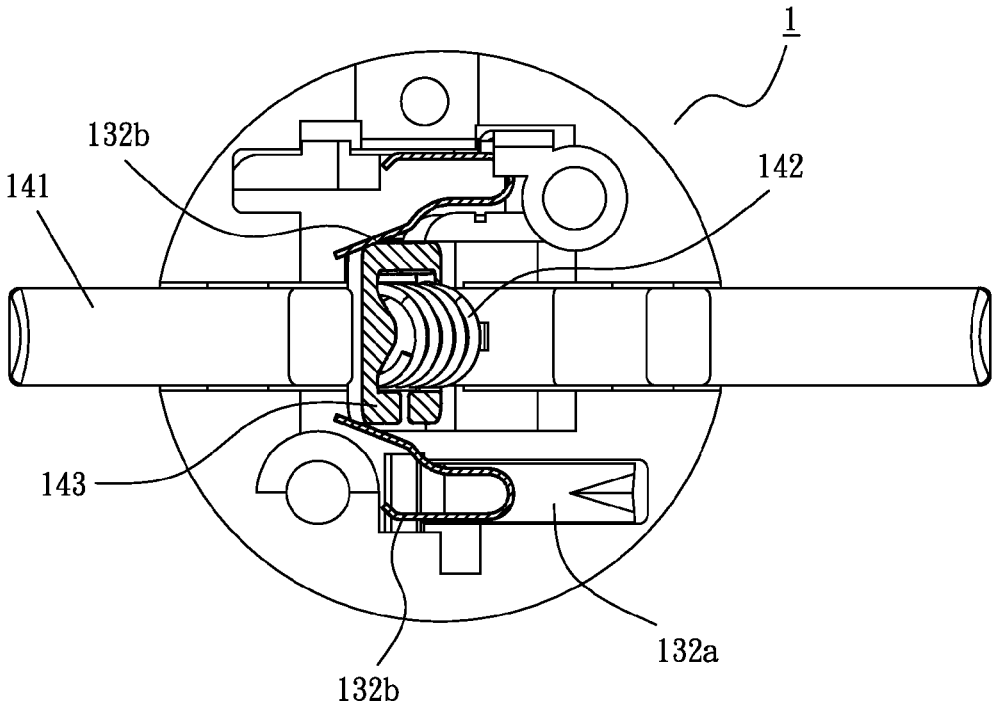
FIG. 2 (PRIOR ART)
FIG. 2 is a schematic view of a push handle of a conventional lampholder conducting conductive plates on both sides.
Figure 3:
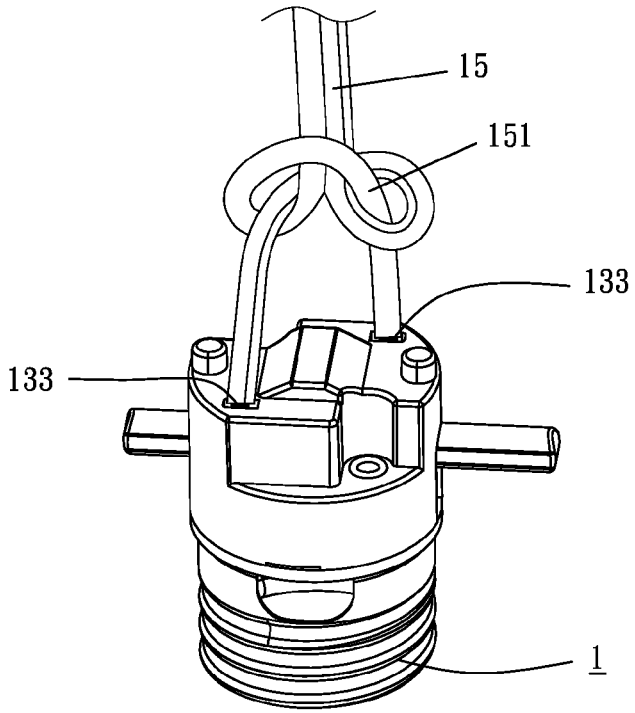
FIG. 3 (PRIOR ART)
FIG. 3 is a schematic view of a UL knot tied at a conventional lampholder for an electric connection.
Figure 4:
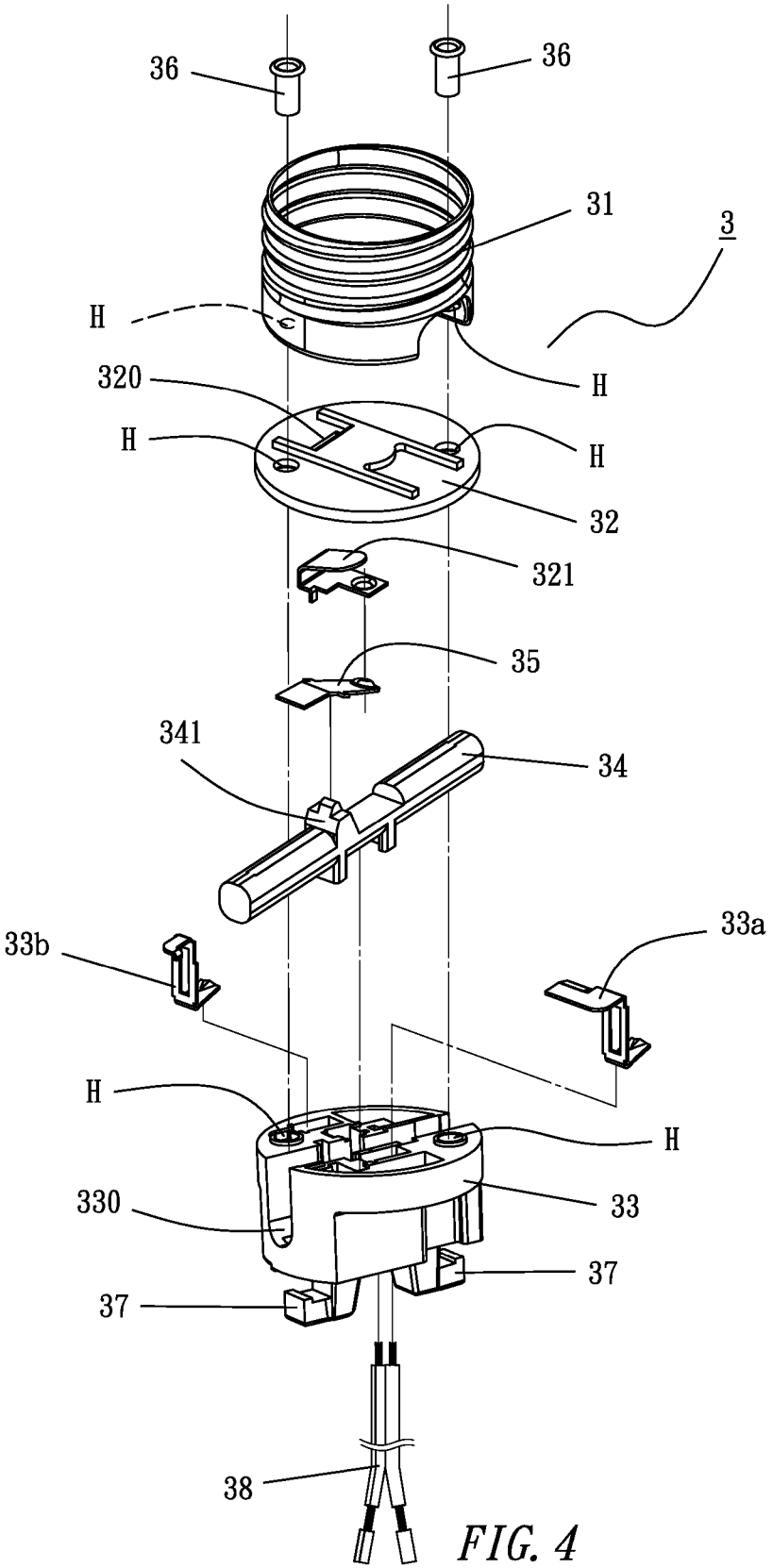
FIG. 4 is an exploded view of a push handle switch lampholder of a preferred embodiment of the present invention.
Figure 5:
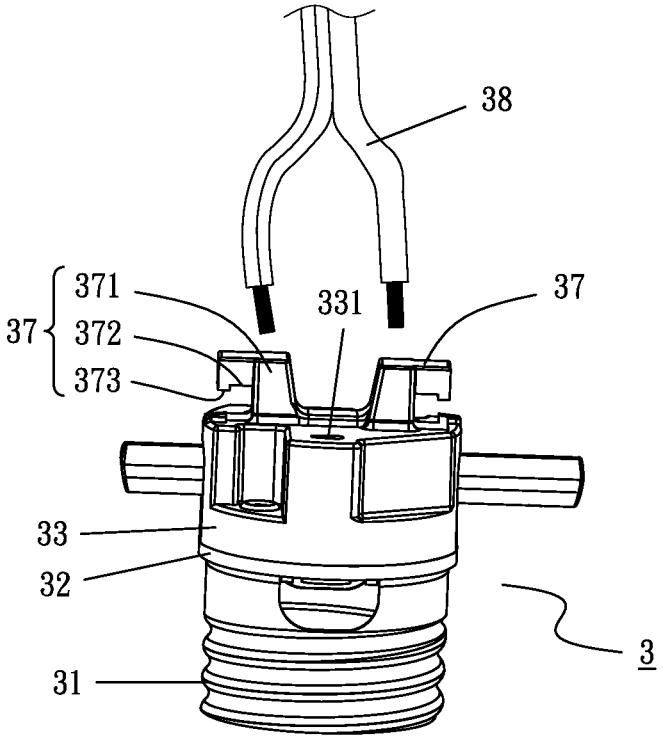
FIG. 5 is an exploded view of a push handle switch lampholder and a power cable of a preferred embodiment of the present invention.

With reference to FIGS. 4 and 5 for a push handle switch lampholder 3 of a preferred embodiment of the present invention, the push handle switch lampholder 3 comprises a cylindrical shell 31, an insulating plate 32, an insulating base 33, a push handle 34, a lower conductive plate 35, a connecting element 36 and a set of hooks 37, wherein the cylindrical shell 31 is formed by a conductive plate into a substantially cylindrical shape with a threaded mouth and a containing space formed at the top and the bottom of the cylindrical shell 31 separately and provided for screwing and connecting a light emitting element such as a light bulb (not shown in the figure), so that a first electrode of the light emitting element is attached and contacted with the cylindrical shell 31 to define an ON state.

The insulating plate 32 is installed at the bottom of the cylindrical shell 31, and a connecting groove 320 is formed for passing and embedding an upper conductive plate 321, and the top end of the upper conductive plate 321 is exposed from the top of the insulating plate 32 and extended into the containing space of the cylindrical shell 31 and contacted with and electrically coupled to the second electrode of the light emitting element, and the other end of the upper conductive plate 321 is extended to the bottom of the insulating plate 32.

The insulating base 33 is installed at the bottom of the insulating plate 32, and includes a containing groove 330 concavely formed at the top and bottom of the insulating plate 32 penetrated through the insulating plate 32.

The push handle 34 is in a shape matched with the containing groove 330 to facilitate its installation in the containing groove 330, and a reciprocating push movement can be performed along the containing groove 330, and the push handle 34 includes a protruding portion 341 protruded from the push handle 34.

The lower conductive plate 35 is substantially in a curved shape matched with the top edge of the containing groove 330, so that the conductive plate 35 can be movably fixed at the top edge of the containing groove 330 and at a position proximate to the protruding portion 341.

The insulating base 33 includes a positive electrode plate 33*a* and a negative electrode plate 33*b* embedded into both sides of the containing groove 330 respectively, and an end of the positive electrode plate 33*a* is exposed from the top of the insulating base 33 and extended to the top of the containing groove 330 and at a position proximate to the lower conductive plate 35, and the other end of the positive electrode plate 33*b* is extended downwardly inside the insulating base 33. An end of the negative electrode plate 33*b* is extended out from the top of the insulating base 33, and the other end is also extended downwardly inside the insulating base 33. The insulating base 33 has a set of plug slots 331 formed at positions opposite to an external surface of the containing groove 330 1 and an interior corresponding to terminals of the positive electrode plate 33*a* and the negative electrode plate 33*b* (as shown in FIG. 5). The connecting element 36 is a rivet, a screw, or an electrically conductive object used for connection, but the present invention is not limited to these arrangements only. At least one hole H is formed separately at corresponding positions of the cylindrical shell 31, the insulating plate 32 and the insulating base 33, and the holes H are provided for passing the connecting element 36 to secure the cylindrical shell 31, the insulating plate 32 and the insulating base 33. A terminal of the negative electrode plate 33*b* extended from an end of the top of the insulating base 33 is extended into the hole H of the insulating base 33 proximate to the negative electrode plate 33*b*. After the connecting element 36 is passed through the hole H, a terminal of the negative electrode plate 33*b* can be electrically coupled to the connecting element 36.

With reference to FIGS. 4 and 5, a set of hooks 37 is formed on an external surface of the insulating base 33 and disposed near the positions of the corresponding to plug slots 331 respectively, and each hook 37 has a vertical column 371 integrally formed with the insulating base 33 to assure the required tensile resistance, and the vertical column 371 has a hook portion 372 extended outwardly from the top edge of the vertical column 371, and a rear end protruded downwardly to form an assisting hook end 373, so as to define a first interval between the hook portion 372 and the external surface of the insulating base 33 and a second interval b between the assisting hook end 373 and the external surface of the insulating base 33, wherein both of the first interval and the second interval are preferably smaller than the diameter of the power cable 38, and the second interval is preferably smaller than the first interval.

Figure 6:
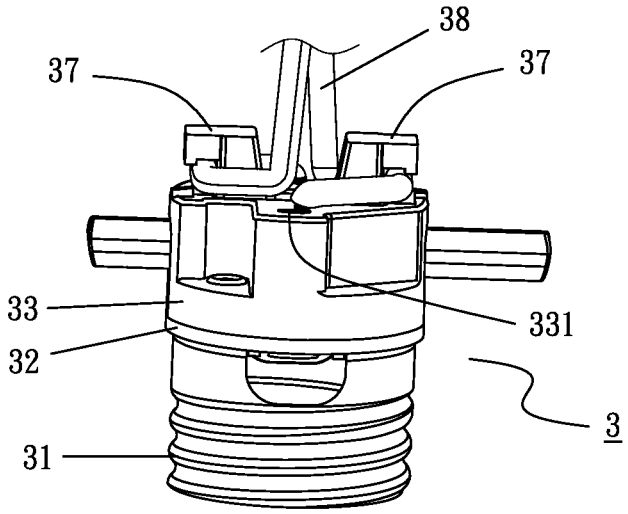
FIG. 6 is a schematic view of a push handle switch lampholder without requiring an UL knot in accordance with a preferred embodiment of the present invention.

In FIG. 6, after the push handle switch lampholder 3 of the present invention is assembled, both bare ends of the power cable 38 are plugged into the plug slots 331, such that both bare ends of the power cable 38 in the plug slots 331 push the terminals of the positive electrode plate 33*a* and the negative electrode plate 33*b* respectively for an electric connection. Further, a rear end of the power cable 38 near the bare end of the power cable 38 is plugged into the corresponding hook 37, such that the power cable 38 can be pushed across the assisting hook end 373 and entered into the hook portion 372. Now, the power cable 38 and the hook portion 372 are situated at a pushed state to achieve the effect of securely connecting the power cable 38 and the hook portion 372, so as to complete the wire connection between the switch lampholder 3 and the power cable 38 and prevent the power cable 38 from being separated from the switch lampholder 3 easily.

Figure 7:
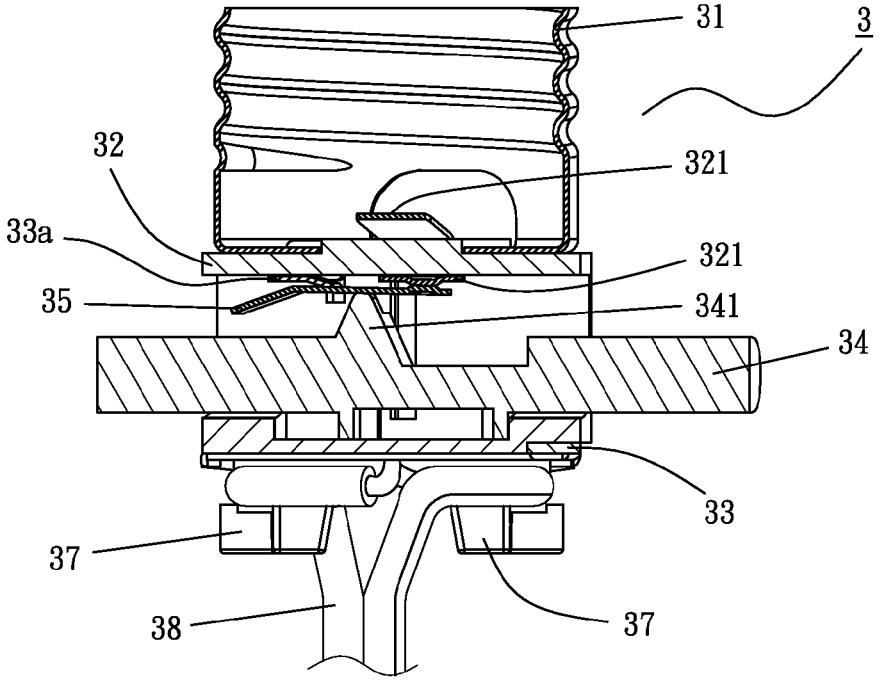
FIG. 7 is a schematic view of a circuit situated at an ON state in accordance with a preferred embodiment of the present invention.

After the push handle switch lampholder 3 of the present invention is assembled as shown in FIG. 6, an external insulating casing can be sheathed on the external surface to become a push handle switch lampholder, or the switch lampholder 3 is assembled together with a whole lamp for its application, but such arrangement is not the main point of the invention, and thus will not be described in details. When the push handle switch lampholder 3 of the present invention is assembled and connected, and the light emitting element is screwed and positioned in the cylindrical shell 31, a user can push the push handle 34 to move towards a side of the containing groove 330 as shown in FIG. 7, so that the protruding portion 341 of the push handle 34 abuts a position near an end of the lower conductive plate 35 and drives the lower conductive plate 35 to swing by using the top edge of the containing groove 330 as a fulcrum and move an end of the lower conductive plate 35 towards the upper conductive plate 321 to contact and conduct with the upper conductive plate 321.

Now, the power cable 38 is electrically coupled to the second electrode of the light emitting element through the positive electrode plate 33*a*, the lower conductive plate 35 and the upper conductive plate 321 to define the ON state, and another power cable 38 is electrically coupled to the first electrode of the light emitting element through the negative electrode plate 33*b*, the connecting element 36 and the cylindrical shell 31, so that the light emitting element is turned on by the circuit connection.

Figure 8:
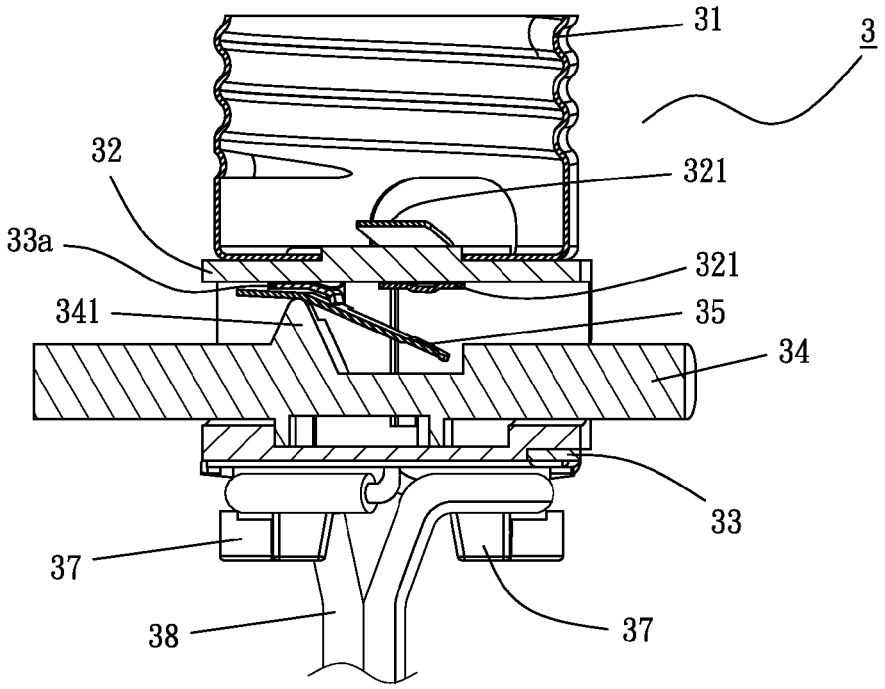
FIG. 8 is a schematic view of a circuit situated at an OFF state in accordance with a preferred embodiment of the present invention.

In FIG. 8, when a user pushes the push handle 34 to move towards another side of the containing groove 330, the protruding portion 341 abuts a position at the other end near the lower conductive plate 35, so that the lower conductive plate 35 is swung by using the top edge of the containing groove 330 as a fulcrum, so as to move in a direction away from the upper conductive plate 321 and separate from the attachment with the upper conductive plate 32, and electrically disconnect the power cable 38 from the second electrode of the light emitting element to achieve the OFF state. In other words, the light emitting element is turned off by the circuit disconnection, so that the push handle 34 can be pushed reciprocally in order to turn on or off the light emitting element conveniently.

In the push handle switch lampholder of the present invention, the lower conductive plate 35 is simply disposed at the top edge of the containing groove 330 without the need of being contained in the containing groove 330, so that the total volume of the insulating base 33 can be minimized for a light and compact design to lower the manufacturing cost of the molding process as well as the storage and transportation costs. In addition, the present invention adopts the lower conductive plate 35 and the upper conductive plate 321 attached with each other to produce a circuit conduction, so that current can be passed through easily without producing much heat or deteriorating and embrittling the lower conductive plate 35 to achieve the effect of improving the overall service life of the lampholder 3. Particularly, the present invention adopts the hooks 37 to connect the power cable 38 securely and prevent the power cable 38 from being separated from the switch lampholder 3 effectively.

In summation, the push handle of the present invention is pushed to move reciprocally, so as to drive the lower conductive plate to move like a see-saw, and determine whether or not to electrically conduct the upper conductive plate. Therefore, the invention can achieve the effects of simplifying components, reducing the volume, controlling the light emitting element emit light, lowering the storage and transportation costs, and improving the service life of the lampholder effectively. Meanwhile, the hooks are provided for securely connecting the power cable for an electric connection without the need of tying an UL knot to provide a quicker, more convenient and secured wire connection.

In summation of the description above, the present invention achieves the expected objectives and effects and complies with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. A push handle switch lampholder, comprising:

a cylindrical shell, formed by a conductive plate into a substantially cylindrical shape, and having a threaded mouth, and a containing space separately formed at the top and the bottom of the interior of the cylindrical shell, for screwing and connecting a light emitting element, such that a first electrode of the light emitting element is attached to the cylindrical shell for an electric conduction;

an insulating plate, installed at the bottom of the cylindrical shell, and having a connecting groove for passing and embedding an upper conductive plate, and the top of the insulating plate being exposed from the top end of the upper conductive plate and extended into the containing space of the cylindrical shell, and contacted with a second electrode of the light emitting element for an electric conduction, and the other end of the upper conductive plate being extended to the bottom of the insulating plate;

an insulating base, installed at the bottom of the insulating plate, and having a containing grove concavely formed at the top of the insulating plate and transversally penetrating through the top of the insulating plate, a set of plug slots formed on an external surface opposite to the containing groove for plugging and connecting a power cable; and a set of hooks disposed proximate to the corresponding plug slots respectively for connecting the power cable;

a push handle, installed in the containing groove, and capable of performing a reciprocating push movement along the containing groove, and having a protruding portion protruded from the push handle; and a lower conductive plate, being substantially in a curved shape matched with the top edge of the containing groove, for being movably fixed at a position of the containing groove corresponding to the protruding portion;

thereby, in the process of performing the reciprocating push movement by the push handle, the protruding portion of the push handle abuts a position proximate to an end of the lower conductive plate, such that an end of the upper conductive plate is moved in a direction towards the upper conductive plate and contacted with the upper conductive plate to electrically connect and light up the light emitting element, and when the protruding portion abuts a position proximate to the other end of the lower conductive plate, an end of the lower conductive plate is moved in a direction away from the upper conductive plate and separated from the upper conductive plate to electrically disconnect and turns off the light emitting element.

2. The push handle switch lampholder of claim 1, wherein the insulating base includes a positive electrode plate and a negative electrode plate embedded into both sides of the containing groove respectively, and an end of the positive electrode plate is exposed from the top of the insulating base and extended to a position of the top of the containing groove proximate to the lower conductive plate, and the other end of the positive electrode plate is extended downwardly inside the insulating base 33 and corresponding to one of the plug slots, and an end of the negative electrode plate is extended out from the top of the insulating base, and the other end of the negative electrode plate is extended downwardly inside the insulating base and corresponding to another plug slot, so that when the power cable is plugged into the corresponding plug slots, the power cable is connected with terminals of the positive electrode plate and the negative electrode plate for an electric connection.

3. The push handle switch lampholder of claim 1, further comprising a connecting element, and at least one hole formed at corresponding position of the cylindrical shell, the insulating plate and the insulating base for passing the connecting element to secure the cylindrical shell, the insulating plate and the insulating base.

4. The push handle switch lampholder of claim 3, wherein the negative electrode plate is extended from a terminal at the top of the insulating base to a hole formed on the insulating base and proximate to the negative electrode plate, such that after the connecting element is passed through the hole, a terminal of the negative electrode plate is electrically coupled to the connecting element.

5. The push handle switch lampholder of claim 1, wherein each hook includes a vertical column integrally formed with the insulating base, and the top edge of the vertical column is extended outwardly to form a hook portion, and the rear end is protruded downwardly to form an assisting hook end; and when the power cable is pushed across the assisting hook end to enter into the hook portion, the power cable and the hook portion are connected securely with each other.

* * * * *